United States Patent [19]

Rosenberg

[11] 4,389,062

[45] Jun. 21, 1983

[54] ROTARY LATCH

[75] Inventor: Kenneth W. Rosenberg, St. Louis, Mo.

[73] Assignee: The United States of America as represented by the Secretary of the Navy, Washington, D.C.

[21] Appl. No.: 216,722

[22] Filed: Dec. 15, 1980

[51] Int. Cl.[3] ..... E05C 3/04

[52] U.S. Cl. ..... 292/190; 292/241; 292/207

[58] Field of Search ..... 70/432, 41, 42; 292/190, 241, 207

[56] References Cited

U.S. PATENT DOCUMENTS

| | | | |
|---|---|---|---|
| 165,005 | 6/1875 | Knorp | 292/202 |
| 243,625 | 6/1881 | Rominger | 292/202 X |
| 2,592,239 | 4/1952 | Brown | 292/241 |
| 2,603,515 | 7/1952 | Thomas | 292/207 |
| 2,919,569 | 1/1960 | Davis | 292/240 X |
| 3,254,517 | 6/1966 | Wheeler | 70/97 |
| 3,503,642 | 3/1970 | Poe | 292/101 |
| 3,907,348 | 9/1975 | Bates et al. | 292/241 X |
| 4,155,575 | 5/1979 | Poe | 292/190 |
| 4,213,642 | 7/1980 | Poe et al. | 292/241 |
| 4,264,092 | 4/1981 | Bourne | 292/241 |

*Primary Examiner*—Richard E. Moore

[57] ABSTRACT

A rotary latch having drive means rotatably mounted in a housing, said drive means having a semi-circular hooked-shaped latch arm thereon. A cover is attached to said housing and an axially mounted, spring-biased shaft is concentrically mounted within said drive means and has locking lugs engageable with said drive means and said cover. In one axial position of said center shaft, said drive means is locked against rotation and, in another axial position, the drive means is unlocked and free to rotate. A stop is provided on said drive means and is engageable with said housing to limit rotation of latch arm.

5 Claims, 4 Drawing Figures

ROTARY LATCH

BACKGROUND OF THE INVENTION

The present invention relates to a rotary latch for engaging a striker assembly and more particularly to a rotary latch having means for preventing rotation of a locking latch when in an engaged position. Also, there is a visual indication which indicates when the latch is locked or unlocked.

The rotary latch of the present invention is well suited for use on aircraft for securing in position such components as access doors, inspection plates, removable panel or cowl sections and fuselage and nacelle components. The fasteners for these components should be adapted to effect ready and quick disconnection of the components when desired, and where the components form part of the external surfaces of the aircraft, the fastening devices used therewith should be designed for flush mounting whereby there results a minimum of discontinuity in the component surfaces, and a minimum of resistance to the airstream for desirable strength and aerodynamic drag characteristics. Various fasteners are to be found in the prior art for accomplishing these objectives, but generally they are complicated and heavy or are deficient in strength and reliability, or generate undesirable aerodynamic turbulence where used on external aircraft surfaces.

SUMMARY OF THE INVENTION

The present invention relates to a rotary latch for use with a striker assembly and is particularly useful in latching doors on aircraft. A hook-shaped latch is rotatably mounted in a housing and a turning tool, which engages a tool aperture, is needed to rotate the hook-shaped latch. A spring-biased shaft extends into the tool aperture and serves as an indicator that the latch is in either a locked or unlocked position. The spring biased shaft is provided with a locking lug which is engaged with a locking slot in a cover to prevent rotation of the shaft, and the locking lug is also engageable with a locking slot on the latch to prevent rotation of the latch when the latch is in an engaged position. Unlocking of the latch is accomplished by the engagement of a turning tool which depresses the shaft when the turning tool is engaged in the tool aperture.

It is therefore a general object of the present invention to provide an improved rotary latch for use on locking doors.

Another object of the present invention is to provide a locking assembly which has a visual indication as to whether the assembly is in a locked or unlocked condition.

Other objects, advantages and novel features of the present invention will become apparent from the following detailed description of the invention when considered in conjunction with the accompanying drawing.

DESCRIPTION OF THE PREFERRED EMBODIMENT

Figure 1:
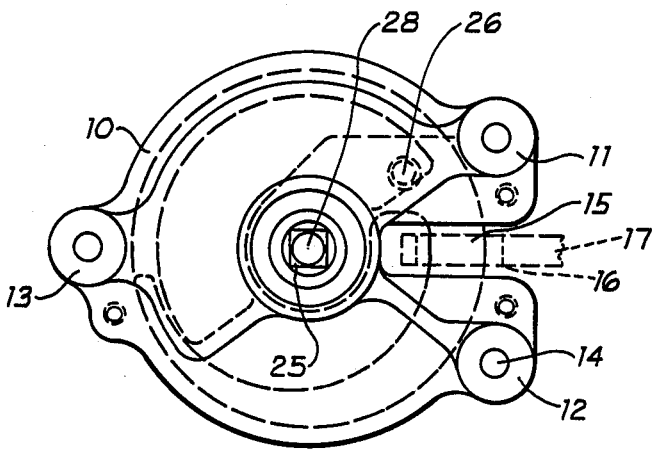
FIG. 1 is a top plan view of a preferred embodiment of the present invention.

Referring first to FIG. 1 of the drawing, there is shown a housing 10 having three bosses 11, 12, and 13 to facilitate attachment to a surface, such as a surface of an aircraft door.

Figure 2:
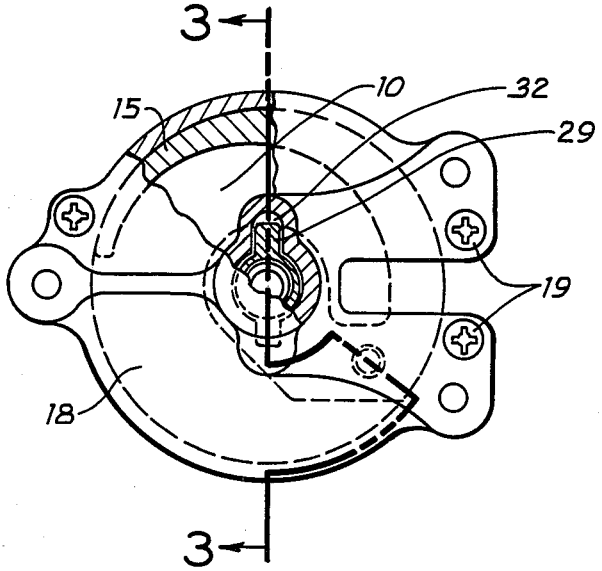
FIG. 2 is a bottom view of the preferred embodiment shown in FIG. 1.
Figure 3:
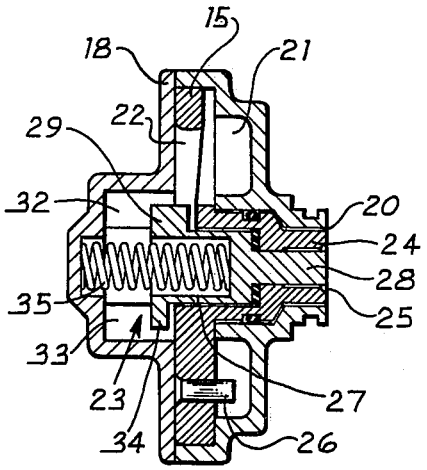
FIG. 3 is a sectional view taken on line 3—3 of FIG. 2.

Each boss is provided with a through hole 14 through which a bolt may be passed in order to attach housing 11 to a door or other component. In FIGS. 1, 2, and 3, of the drawing, the embodiment is depicted in a locked position and a hooked-shape latch 15 would be engaged through a slot 16 in a striker 17. A cover 18 is attached to housing 11 by means of screws 19. As best shown in FIGS. 1 and 3 of the drawing, housing 11 is provided with a journaled bore 20, a semi-circular groove 21 and an enlarged bore 22. A latching mechanism 23 is provided with a cylindrical section 24 which is rotatably mounted in bore 20, and the hook-shaped latch 15 is positioned in the enlarged bore 22. The end of cylindrical section 24 is provided with a square hole 25 for receiving a turning tool. A rivet 26 is attached to latching mechanism 23 and extends into groove 21, and rivet 26 limits rotation of latching mechanism 23 to about 180 degrees.

Figure 4:
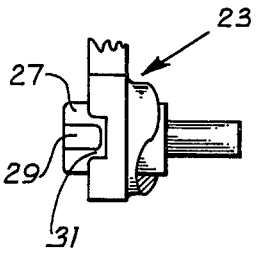
FIG. 4 is a partial view showing a locking lug on a shaft engaging a locking slot on a latch.

A locking shaft 27 is positioned within bores of latching mechanism 23 and shaft 27 has a reduced diameter portion 28 that extends into the square hole 25 in cylindrical section 24. FIG. 3 of the drawing shows an embodiment in a locked position, and it can be seen that the front edge of reduced diameter portion 28 is flush with the front end of cylindrical section 24. Thus a visual indication is provided to indicate a locked condition. Locking of mechanism 23 is accomplished by a locking lug 29 on shaft 27 which engages a locking slot 31 in latching mechanism 23, as best shown in FIG. 4 of the drawings. Rotation of shaft 27 is prevented by a pair of slots 32 and 33 which are made integral with cover 18. Locking lug 29 is slidably positioned in slot 32 and a second lug 34 on shaft 27 is slidably positioned in slot 33. A spring 35 biases shaft 27 in the locked position shown in FIG. 3 of the drawing, and shaft 27 can move linearly but can not be rotated. The length of locking lug 29 is sufficient so that lug 29 can simultaneously engage both locking slots 31 and 32 thus preventing rotation of latching mechanism 23.

OPERATION

FIGS. 1, 2, and 3 of the drawing, show a rotary latch in a locked position and hook latch 15 would normally be engaged with a striker 17, as shown in FIG. 1. Spring 35 biases locking shaft 27 so that locking lug 29 is engaged in locking slot 31 of latching mechanism 23 and, as locking shaft 27 is constrained from rotation because of engagement of lugs 29 and 34 with slots 32 and 33, respectively, latching mechanism 23 is constrained from rotation. As shown in FIG. 3 of the drawing, the reduced diameter portion 28 of locking shaft 27 has its front edge flush with the front edge of cylindrical section 24 of latching mechanism 23 and thus provides a visual indication that latching mechanism 23 is in a locked position. Rivet 26 is against one end of groove 21 which serves as a stop.

Unlocking of hook latch 15 from striker 17 is accomplished by a turning tool which has a square end for engaging square hole 25 in cylindrical section 24 of latching mechanism 23. Insertion of the turning tool moves locking shaft 27 inwardly, thereby compressing spring 35, and locking lug 29 is displaced from locking slot 31. Latching mechanism 23 can then be rotated in a counter-clockwise direction for about 180 degrees, until rivet 26 reaches the other end of groove 21. Once locking lug 29 is disengaged from locking slot 31 and locking shaft 27 is rotated, locking lug 29 prevents outward movement of shaft 24, even when the turning tool is removed, and thus the forward end of reduced diameter portion 28 cannot be aligned with the forward edge of cylindrical section 24. Thus a visual indication is presented that latching mechanism 23 is in an unlocked condition. After about 180 degrees of rotation, the hook latch 15 will be completely clear of striker 17 and a door to which the rotary latch is attached can be opened.

Upon closing a door to which the rotary latch is attached, rotation of latching mechanism 23 in a clockwise direction causes hook latch 15 to again engage striker 17 and, after about 180 degrees of rotation, rivet 26 will reach the end of semi-circular groove 21. At this position, locking lug 29 will again be aligned with locking slot 31 and, upon removal of the turning tool, spring 35 will bias locking shaft 27 outwardly thereby causing locking lug 29 to engage locking slot 31 and lock latching mechanism 23.

Obviously many modifications and variations of the present invention are possible in the light of the above teachings. It is therefore to be understood that the invention may be practiced otherwise than as specifically described.

I claim:

1. A rotary latch for engagement with a striker loop, said latch comprising, a housing having a journaled bore, an enlarged bore and a semi-circular groove therein, a cover closing said enlarged bore and said semi-circular groove, said cover having at least one locking slot therein, latching means rotatably positioned in said journaled bore and having a hooked-shaped latch extending into said enlarged bore of said housing, said latching means having a locking slot therein, stop means on said latching means extending into said semi-circular groove, a shaft axially slidable within said latching means and having at least one locking lug slidably positioned in said locking slot in said cover and selectively engageable with said locking slot in said latching means, and spring means biasing said shaft whereby said locking lug on said shaft is engaged with both said locking slot on said latching means and said locking slot in said cover to prevent rotation of said latching means.

2. A rotary latch for engagement with a striker loop as set forth in claim 1 wherein said latching means is provided with a tool aperture for receiving a turning tool and whereby said shaft extends into said tool aperture to indicate a locked position of said latching means.

3. A rotary latch for engagement with a striker loop as set forth in claim 2 wherein said shaft is mounted within a cylindrical bore in said latching means and said latching means is rotatable relative to said shaft upon disengagement of said locking lug on said shaft from said locking slot in said latching means.

4. A rotary latch for engagement with a striker loop as set forth in claim 3 having means for maintaining disengagement of said locking lug on said shaft from said locking slot in said latching means.

5. A rotary latch for engagement with a striker loop as set forth in claim 1 wherein said stop means comprises a rivet attached to said latching means.

* * * * *